US005906110A

United States Patent [19]

Choi

[11] Patent Number: 5,906,110

[45] Date of Patent: May 25, 1999

[54] DIRECT COOLING TYPE REFRIGERATOR HAVING A DEFROSTED WATER RECEIVING/DISCHARGING APPARATUS

[75] Inventor: Woo-Yeup Choi, Seoul, Rep. of Korea

[73] Assignee: Daewoo Electronics Co., Ltd., Seoul, Rep. of Korea

[21] Appl. No.: 08/940,986

[22] Filed: Sep. 30, 1997

[30] Foreign Application Priority Data

Sep. 30, 1996 [KR] Rep. of Korea ..... 96-43330

[51] Int. Cl.[6] ..... F25D 21/14

[52] U.S. Cl. ..... 62/291

[58] Field of Search ..... 62/285, 286, 291, 62/288, 272

[56] References Cited

U.S. PATENT DOCUMENTS

| | | | |
|---|---|---|---|
| 1,684,563 | 9/1928 | Swedman | 62/291 |
| 2,047,415 | 7/1936 | Horvath et al. | 62/291 |
| 2,297,859 | 10/1942 | Anderson | 62/286 |
| 2,408,582 | 10/1946 | Rosebrook et al. | 62/291 |
| 2,555,968 | 6/1951 | Harbison | 62/286 |
| 2,595,456 | 5/1952 | Hinkel | 62/291 |
| 2,627,729 | 2/1953 | Philipp | 62/291 |
| 2,681,550 | 6/1954 | McCloy | 62/291 |
| 2,975,616 | 3/1961 | Saunders | 62/291 |

*Primary Examiner*—William Doerrler
*Attorney, Agent, or Firm*—Cushman Darby & Cushman IP Group of Pillsbury Madison & Sutro LLP

[57] ABSTRACT

A direct cooling type refrigerator having a defrosted water receiving/discharging apparatus. The apparatus has a defrosted water tray disposed below an evaporator for receiving a defrosted water dropping from the evaporator, and a defrosted water discharging device coupled to the defrosted water tray to discharge the defrosted water from the defrosted water tray. The defrosted water tray has a bottom wall having a flat portion and an inclined portion which is inclined upward with respect to the flat portion for guiding the defrosted water toward the flat portion. The defrosted water discharging device has a body having an inner wall forming a water passage communicated with the defrosted water tray, and at least one water discharging hole formed at a predetermined position on a bottom portion of the water passage. A user can easily remove a defrosted water collected in the defrosted water tray without completely drawing out the defrosted water tray from the refrigerator. The apparatus has a simple construction and can be easily manufactured.

10 Claims, 4 Drawing Sheets

DIRECT COOLING TYPE REFRIGERATOR HAVING A DEFROSTED WATER RECEIVING/DISCHARGING APPARATUS

BACKGROUND OF THE INVENTION

1. Field of the Invention

The present invention relates to a direct cooling type refrigerator, and more particularly to a direct cooling type refrigerator having a defrosted water receiving/discharging apparatus which receives a defrosted water dropping from an evaporator and discharges the defrosted water out of the apparatus.

2. Prior Art

Generally, a refrigerator is an appliance for storing various foodstuffs in either a frozen or a refrigerated condition to extend the length of the freshness of the foodstuffs. Such refrigerator includes a compressor which circulates a refrigerant by compressing the refrigerant, an evaporator which evaporates the refrigerant by dropping pressure of the refrigerant, thereby generating a chilled air, and a condenser by which the evaporated refrigerant is condensed into a liquified refrigerant and then is circulated into the compressor. The chilled air generated from the evaporator flows into an interior of the refrigerator through a blowing fan.

The above described refrigerator is commonly provided with a freezing chamber for storing frozen foods such as meats or an ice cream and a refrigerating chamber for storing foods at a relatively lower temperature. The refrigerator is classified into an indirect cooling type refrigerator in which the freezing chamber is separately installed from the refrigerating chamber, and a direct cooling type refrigerator in which the freezing chamber is formed by an evaporator disposed at an upper portion of the refrigerating chamber.

The direct cooling type refrigerator has a cabinet in which the freezing chamber and the refrigerating chamber are provided, and a door coupled to a front portion of the cabinet so as to open/close the freezing chamber and the refrigerating chamber together. In the direct cooling type refrigerator, the evaporator is disposed in the refrigerating chamber having a relatively higher temperature than the temperature of the evaporator so that frost can be formed beneath the evaporator. Accordingly, there is provided a separate heater for removing the frost. For this reason, a defrosted water tray for receiving water formed from melted frost is disposed below the evaporator in order to prevent water from dropping into foods stored in the refrigerating chamber.

FIG. 1, shows a conventional direct cooling type refrigerator 100 having a defrosted water tray 3. As shown in FIG. 1, refrigerator 100 comprises a cabinet 1 formed with a refrigerating chamber 6 therein. Refrigerating chamber 6 is provided at its upper portion with an evaporator 2 forming a freezing chamber 5. Evaporator 2 extends across the width of refrigerating chamber 6 and both ends thereof are bent toward a top surface of refrigerator 100. Evaporator 2 has a refrigerant path therein for dissipating a chilled air into freezing chamber 5.

In addition, defrosted water tray 3 is detachably mounted on ridges 4 which are formed at an inner wall of refrigerator 100. Defrosted water tray 3 has a recess 7 therein for collecting water.

When a predetermined amount of water is collected in recess 7 of defrosted water tray 3, a user manually removes defrosted water tray 3 from ridges 4, and after pouring out the water from defrosted water tray 3, the user again assembles defrosted water tray 3 with ridges 4.

However, when it is necessary to remove water from defrosted water tray 3, defrosted water tray 3 should be completely separated from refrigerator 100. Particularly, when a large amount of food is placed below defrosted water tray 3, the user should move the food to another side in order to separate defrosted water tray 3 from refrigerator 100. In addition, if an external impact is applied to defrosted water tray 3 while defrosted water tray 3 is being drawn out of refrigerator 100, water collected in recess 7 of defrosted water tray 3 may overflow from defrosted water tray 3.

SUMMARY OF THE INVENTION

The present invention has been made to overcome the above described problems of the prior art, and accordingly it is an object of the present invention to provide a direct cooling type refrigerator having a defrosted water receiving/discharging apparatus by which a user can easily remove a defrosted water collected in a defrosted water tray without completely drawing out the defrosted water tray from the refrigerator.

In order to accomplish the above object, the present invention provides a direct cooling type refrigerator comprising:

- a cabinet having a refrigerating chamber therein;
- a door coupled to the cabinet for opening/closing the refrigerating chamber;
- an evaporator for generating a chilled air, the evaporator forming a freezing chamber, the evaporator being installed at an upper portion of the refrigerating chamber;
- a defrosted water tray for receiving a defrosted water dropping from the evaporator the defrosted water tray being disposed below the evaporator, the defrosted water tray having a bottom wall including a flat portion and an inclined portion which is inclined upward with respect to the flat portion for guiding the defrosted water toward the flat portion; and
- a defrosted water discharging apparatus coupled to the defrosted water tray in order to discharge the defrosted water from the defrosted water tray.

According to a preferred embodiment of the present invention, a front wall of the defrosted water tray, which is adjacent to the flat portion of the bottom wall, is formed with an opening and the defrosted water discharging apparatus is slidably engaged with the opening.

The defrosted water discharging apparatus includes a body slidably engaged with the opening and having an inner wall forming a water passage communicated with the defrosted water tray, at least one water discharging hole formed at a predetermined position on a bottom portion of the water passage, and a cover plate integrally provided at a front portion of the body.

The cover plate has a first size larger than a second size of the opening so that the cover plate makes contact with an outer surface of the front wall of the defrosted water tray when the body enters into the defrosted water tray by a predetermined distance. The opening has a rectangular shape, and the body has a hexahedral shape in which one side is opened.

When a predetermined amount of the defrosted water is collected in the defrosted water tray, a user pulls the defrosted water discharging apparatus until the water discharging hole of the defrosted water discharging apparatus is exposed to an exterior. Then, the defrosted water collected in the defrosted water tray is discharged from the defrosted water tray to the exterior through the water passage and the water discharging hole. At this time, the user should place a separate container below the water discharging hole so as to receive the defrosted water dropping from the discharging hole.

According to the present invention, the user can easily remove a defrosted water collected in the defrosted water tray without completely drawing out the defrosted water tray from the refrigerator. In addition, the defrosted water receiving/discharging apparatus has a simple construction so that it can be easily manufactured.

BRIEF DESCRIPTION OF THE DRAWINGS

The above object and other advantages of the present invention will become more apparent by describing in detail preferred embodiments thereof with reference to the attached drawings, in which.

DESCRIPTION OF THE PREFERRED EMBODIMENTS

Hereinafter, preferred embodiments of the present invention will be described in detail with reference to the accompanying drawings.

Figure 1:
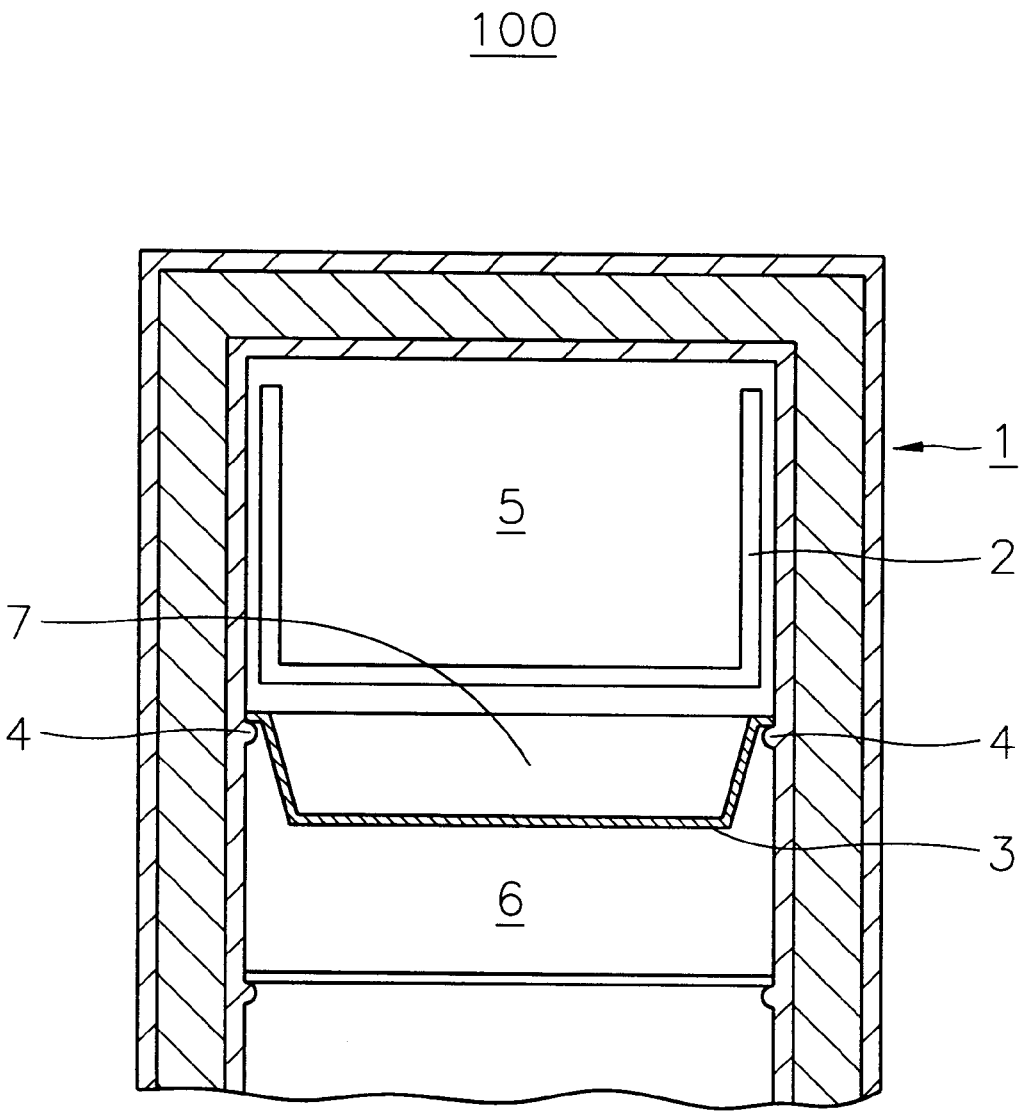
FIG. 1 (PRIOR ART)
FIG. 1 is a sectional view showing a structure of a conventional direct cooling type refrigerator.
Figure 2:
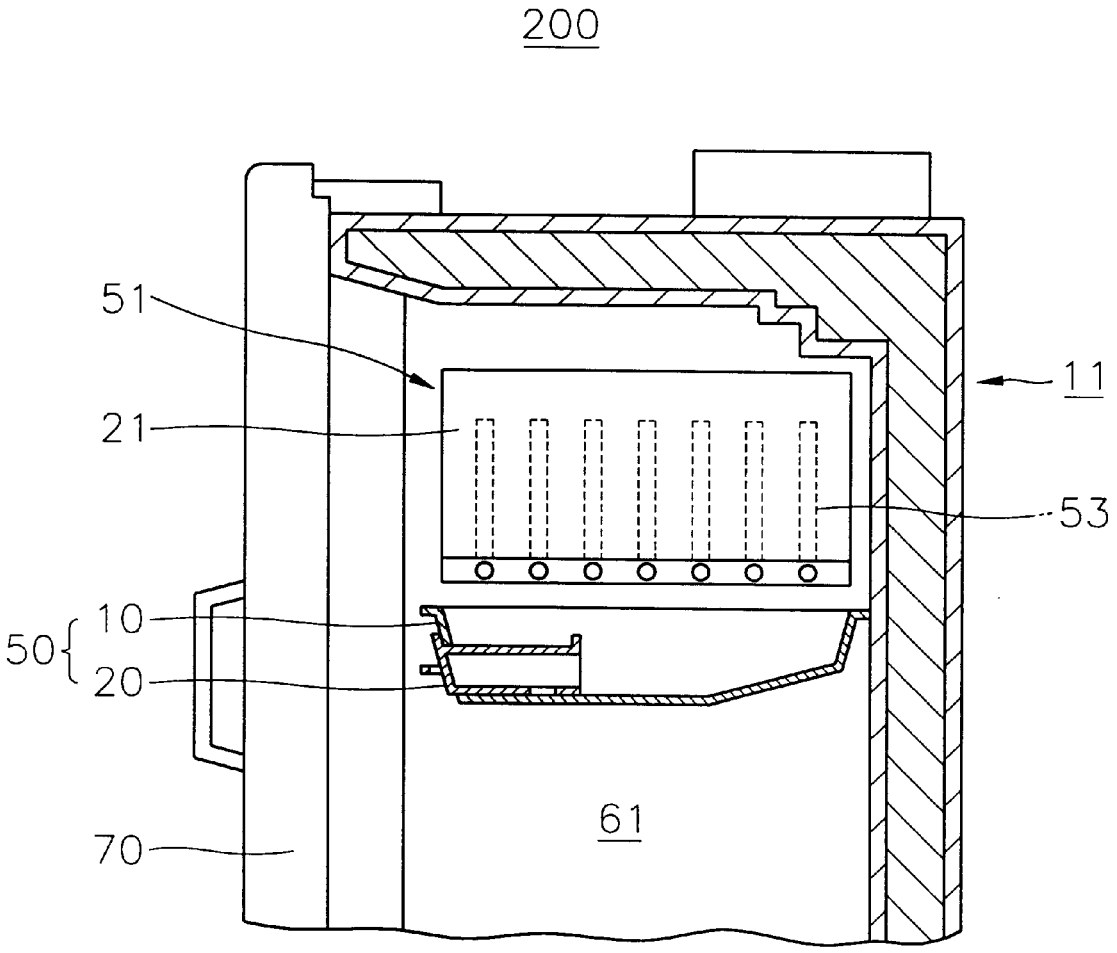
FIG. 2 is a side sectional view showing a structure of a direct cooling type refrigerator having a defrosted water receiving/discharging apparatus according to a first embodiment of the present invention.

FIG. 2 shows a direct cooling type refrigerator 200 having a defrosted water receiving/discharging apparatus 50 according to a first embodiment of the present invention.

As shown in FIG. 2, direct cooling type refrigerator 200 of the present invention has a cabinet 11 having a refrigerating chamber 61 therein. A door 70 is coupled to a front portion of cabinet 11 in order to open/close refrigerating chamber 61. An evaporator 51 for generating a chilled air is installed at an upper portion of refrigerating chamber 61. A freezing chamber 21 is formed by evaporator 51. Evaporator 51 extends across the width of refrigerating chamber 61 and both ends thereof are bent toward a top surface of refrigerator 200. Evaporator 51 has a refrigerant path 53 therein for dissipating a chilled air into freezing chamber 21.

In addition, defrosted water receiving/discharging apparatus 50 is disposed below evaporator 51. Defrosted water receiving/discharging apparatus 50 is detachably mounted on ridges (not shown) which are formed at an inner wall of cabinet 11. Defrosted water receiving/discharging apparatus 50 includes a defrosted water tray 10 for receiving a defrosted water dropping from evaporator 51 and a defrosted water discharging device 20 coupled to a front portion of defrosted water tray 10 in order to discharge the defrosted water from defrosted water tray 10.

Figure 3:
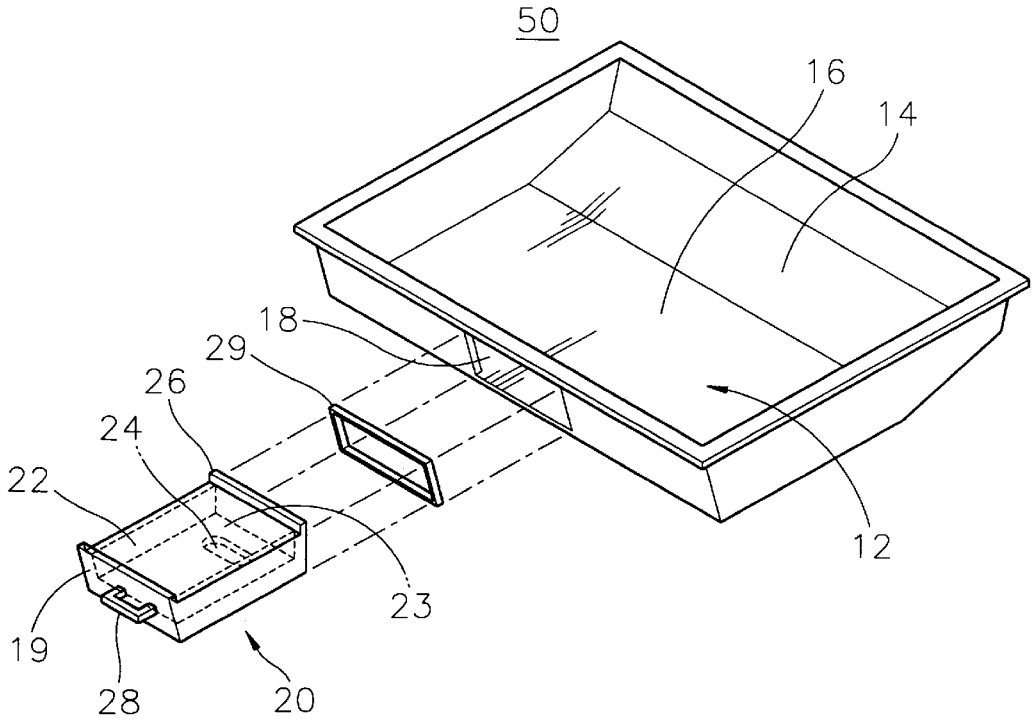
FIG. 3 is an exploded perspective view of a defrosted water receiving/discharging apparatus according to a first embodiment of the present invention.

Referring to FIG. 3, defrosted water tray 10 has a bottom wall consisting of a flat portion 16 positioned adjacent to the front portion of defrosted water tray 10 so as to guide a sliding movement of defrosted water discharging device 20, and an inclined portion 14 which is inclined upward with respect to flat portion 16 for guiding the defrosted water toward flat portion 16. In addition, the front portion of defrosted water tray 10 is formed with an opening 18 into which defrosted water discharging device 20 is slidably inserted.

Defrosted water discharging device 20 enters into a recess 12 of defrosted water tray 10 through opening 18. Defrosted water discharging device 20 has a body 22 having an inner wall forming a water passage 23 communicated with the defrosted water tray, and at least one water discharging hole 24 formed at a predetermined position on a bottom portion of water passage 23. When body 22 is drawn from defrosted water tray 10 by a predetermined distance, the defrosted water collected in defrosted water tray 10 is discharged from defrosted water tray 10 through water passage 23 and water discharging hole 24.

In addition, a cover plate 19 is integrally provided at a front portion of body 22. Cover plate 19 has a first size larger than a second size of opening 18. Accordingly, cover plate 19 makes contact with an outer surface of the front wall of defrosted water tray 10 when body 22 enters into defrosted water tray 10 by a predetermined distance, thereby restraining the entering of body 22 into defrosted water tray 10.

Preferably, body 22 of defrosted water discharging device 20 is designed so as not to be rotated while defrosted water discharging device 20 is being entered into defrosted water tray 10. More preferably, body 22 has a hexahedral shape in which one side is opened. Opening 18 which is formed at the front wall of defrosted water tray 10 has a shape in correspondence with the shape of body 22. In addition, a sealing member 29 is disposed in opening 18 in order to prevent a leakage of the defrosted water from defrosted water tray 10.

Body 22 is integrally formed at a rear end of an upper portion thereof with a stopper 26 for preventing defrosted water discharging device 20 from completely separating from defrosted water tray 10. A knob 28 for facilitating a drawing of defrosted water discharging device 20 from defrosted water tray 10 is integrally formed with a front surface of cover plate 19.

Figure 4:
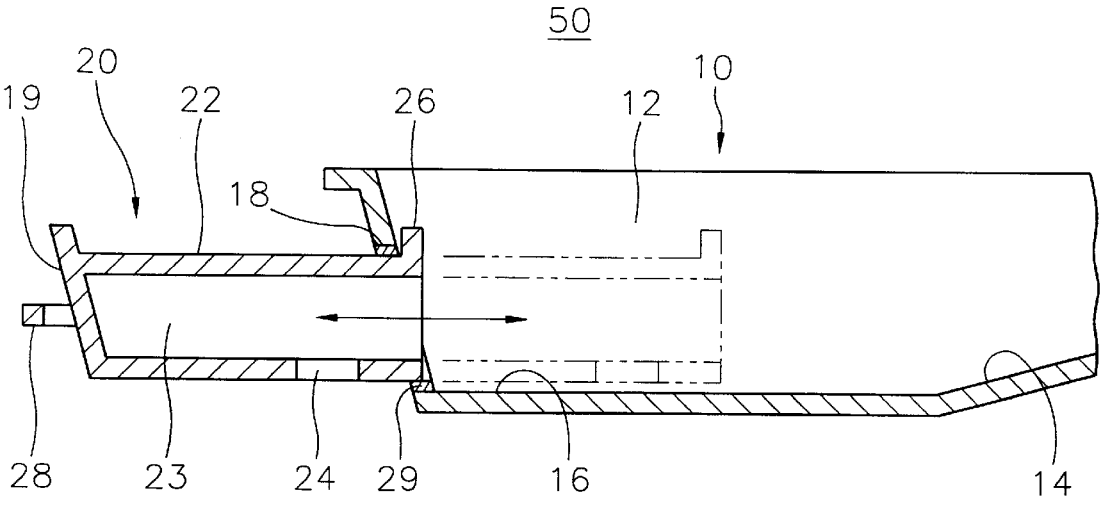
FIG. 4 is a side sectional view showing a defrosted water receiving/discharging apparatus according to a first embodiment of the present invention in a state where a defrosted water discharging apparatus is being drawn out from a defrosted water tray.

FIG. 4 shows defrosted water receiving/discharging apparatus 50 according to a first embodiment of the present invention in a state where defrosted water discharging device 20 is being drawn out from defrosted water tray 10 in order to discharge the defrosted water from defrosted water tray 10. As shown in FIG. 4, when defrosted water discharging device 20 is drawn out from defrosted water tray 10 by a predetermined 10 distance, stopper 26 provided at the rear portion of body 22 makes contact with an inner portion of the front wall of defrosted water tray 10, thereby preventing defrosted water discharging device 20 from completely separating from defrosted water tray 10.

In defrosted water receiving/discharging apparatus 50 having the above construction according to the first embodiment of the present invention, when a predetermined amount of the defrosted water is collected in defrosted water tray 10, a user pulls defrosted water discharging device 20 until water discharging hole 24 of defrosted water discharging device 20 is exposed to an exterior. Then, the defrosted water collected in defrosted water tray 10 is discharged from defrosted water tray 10 to the exterior through water passage 23 and water discharging hole 24. At this time, the user should place a separate container below water discharging hole 24 so as to receive the defrosted water dropping from discharging hole 24.

Figure 5:
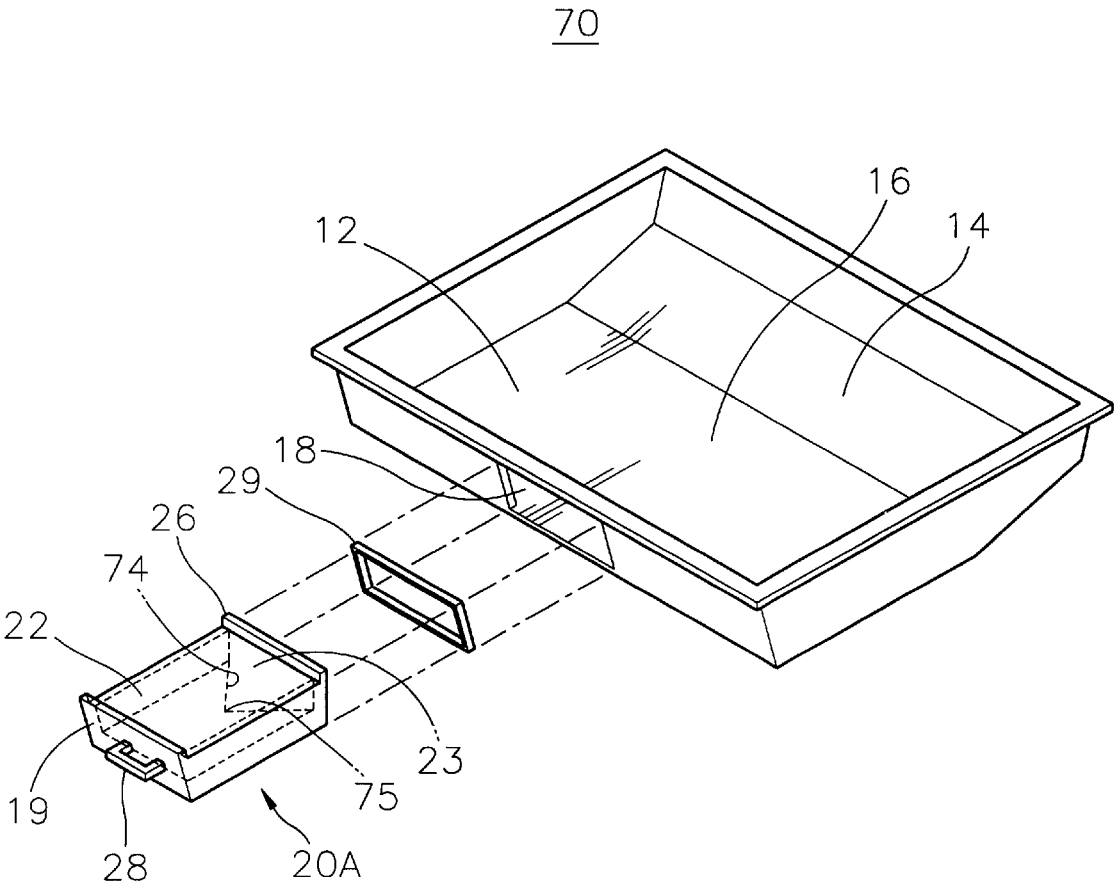
FIG. 5 is an exploded perspective view of a defrosted water receiving/discharging apparatus according to a second embodiment of the present invention.

FIG. 5 shows a water receiving/discharging apparatus 70 according to a second embodiment of the present invention. Water receiving/discharging apparatus 70 according to the second embodiment of the present invention has the same structure as water receiving/discharging apparatus 70 according to the first embodiment of the present invention, except for a V-shaped groove 74 formed at a bottom wall of water passage 23.

As shown in FIG. 5. V-shaped groove 74 is formed at an inlet portion of water passage 23. Accordingly, when the user draws out defrosted water discharging device 20A from defrosted water tray 10, an apex portion 75 of V-shaped groove 74 is communicated with an exterior so that the defrosted water is discharged to the exterior. In this case, the defrosted water collected in defrosted water tray 10 is completely discharged to the exterior.

As described above, according to the present invention, the user can easily remove a defrosted water collected in the defrosted water tray without completely drawing out the defrosted water tray from the refrigerator. In addition, the defrosted water receiving/discharging apparatus has a simple construction so that it can be easily manufactured.

While the present invention has been particularly shown and described with reference to the preferred embodiments thereof, it will be understood by those skilled in the art that various changes in form and detail may be effected therein without departing from the spirit and scope of the invention as defined by the appended claims.

What is claimed is:

1. A direct cooling type refrigerator comprising:

a cabinet having a refrigerating chamber therein;

a door coupled to the cabinet for opening/closing the refrigerating chamber;

an evaporator for generating a chilled air, the evaporator forming a freezing chamber, the evaporator being installed at an upper portion of the refrigerating chamber;

a defrosted water tray for receiving a defrosted water dropping from the evaporator, the defrosted water tray being disposed below the evaporator, the defrosted water tray having a bottom wall including a flat portion and an inclined portion which is inclined upward with respect to the flat portion for guiding the defrosted water toward the flat portion and being formed at a front wall thereof adjacent to the flat portion of the bottom wall with an opening; and a defrosted water discharging apparatus coupled to the defrosted water tray in order to discharge the defrosted water from the defrosted water tray,the defrosted water discharging apparatus being slidably engaged with the opening.

2. The direct cooling type refrigerator as claimed in claim 1, wherein a sealing member is disposed in the opening in order to prevent a leakage of the defrosted water from the defrosted water tray.

3. The direct cooling type refrigerator as claimed in claim 1, wherein the defrosted water discharging apparatus includes a body slidably engaged with the opening and having an inner wall forming a water passage communicated with the defrosted water tray, at least one water discharging hole formed at a predetermined position on a bottom portion of the water passage, and a cover plate integrally provided at a front portion of the body, the cover plate having a first size larger than a second size of the opening so that the cover plate makes contact with an outer surface of the front wall of the defrosted water tray when the body enters into the defrosted water tray by a predetermined distance.

4. The direct cooling type refrigerator as claimed in claim 3, further comprising a knob for facilitating a drawing of the defrosted water discharging apparatus from the defrosted water tray, the knob being integrally formed with the cover plate.

5. The direct cooling type refrigerator as claimed in claim 3, further comprising a stopper for preventing the defrosted water discharging apparatus from completely separating from the defrosted water tray, the stopper being protrudingly formed at a rear end of an upper portion of the body.

6. The direct cooling type refrigerator as claimed in claim 3, wherein the opening has a rectangular shape and the body has a hexahedral shape in which one side is opened.

7. The direct cooling type refrigerator as claimed in claim 1, wherein the opening has a rectangular shape and the defrosted water discharging apparatus includes a hexahedral body slidably engaged with the opening and formed therein with a water passage communicated with the defrosted water tray, a V-shaped groove formed at a predetermined position Of a bottom portion of the water passage, and a cover plate integrally provided at a front portion of the body, the cover plate having a first size larger than a second size of the opening so that the cover plate makes contact with an outer surface of the front wall of the defrosted water tray when the body enters into the defrosted water tray by a predetermined distance.

8. The direct cooling type refrigerator as claimed in claim 7, further comprising a knob for facilitating a drawing of the defrosted water discharging apparatus from the defrosted water tray, and a stopper for preventing the defrosted water discharging apparatus from completely separating from the defrosted water tray, the stopper being protrudingly formed at a rear end of an upper portion of the body, the knob being integrally formed with the cover plate.

9. The direct cooling type refrigerator as claimed in claim 7, wherein the water passage has a rectangular shape and the V-shaped groove is formed at an inlet portion of the water passage.

10. The direct cooling type refrigerator as claimed in claim 7, wherein a sealing member is disposed in the opening in order to prevent a leakage of the defrosted water from the defrosted water tray.

* * * * *